United States Patent [19]

Sato

[11] Patent Number: 4,569,581

[45] Date of Patent: Feb. 11, 1986

[54] SMALL ELECTROPHOTOGRAPHIC COPYING MACHINE WITH TRANSPARENT FILM

[75] Inventor: Masamichi Sato, Kanagawa, Japan

[73] Assignee: Fuji Photo Film Co., Ltd., Kanagawa, Japan

[21] Appl. No.: 466,766

[22] Filed: Feb. 15, 1983

[30] Foreign Application Priority Data

| | | | |
|---|---|---|---|
| Feb. 15, 1982 | [JP] | Japan | 57-21262 |
| Feb. 19, 1982 | [JP] | Japan | 57-24558 |
| Sep. 17, 1982 | [JP] | Japan | 57-160856 |
| Oct. 8, 1982 | [JP] | Japan | 57-177147 |

[51] Int. Cl.[4] ..... G03G 15/00

[52] U.S. Cl. ..... 355/3 BE; 355/3 R; 355/16; 355/84; 355/12

[58] Field of Search ..... 355/16, 12, 3 R, 14 R, 355/3 BE, 3 TR, 78, 84; 430/48; 118/620, 612

[56] References Cited

U.S. PATENT DOCUMENTS

| | | | |
|---|---|---|---|
| 4,167,326 | 9/1979 | Pavne | 355/12 X |
| 4,173,407 | 11/1979 | Kuehnle | 355/12 |
| 4,387,984 | 6/1983 | Sato | 355/12 |

*Primary Examiner*—A. C. Prescott

*Attorney, Agent, or Firm*—Sughrue, Mion, Zinn, Macpeak, and Seas

[57] ABSTRACT

A small sized copying machine employs a film-like transparent member as a support for originals to be copied, which is maintained in close contact with the original and a photosensitive film in an exposure region. The film is exposed from behind to obtain an electrostatic latent image corresponding to said original thereon.

36 Claims, 35 Drawing Figures

SMALL ELECTROPHOTOGRAPHIC COPYING MACHINE WITH TRANSPARENT FILM

BACKGROUND OF THE INVENTION

This invention relates to a small electrophotographic copying machine which is portable, small in size and weight and low in manufacturing cost.

In order to reduce the size, weight and manufacturing cost of a copying machine, the inventor has proposed a support for the originals used with a copying machine of the moving original, slit exposure type, which is made of a transparent film instead of a glass plate (Japanese Patent Application No. 138379/1981).

More, specifically, the inventor has proposed an original placement device for a copying machine having a slit type projection exposure system, which has an original support made of a transparent plastic film and which is laid, under tension, over a frame which is movable relative to an irradiated part of the original, and a plurality of original support holding members which are brought into contact with the plastic film at least near the irradiated part of the lower surface of the original support in order to hold the irradiated part of the original at the exposure position of the exposure system.

SUMMARY OF THE INVENTION

The inventor has conducted intensive research into electrophotographic copying machines having such transparent plastic film original supports in order to remove the defects of the conventional methods, and has developed an electrophotographic copying machine of small size and weight in which a film-shaped electrophotographic photosensitive material on which an electrostatic latent image is formed by applying light from behind the photosensitive material is used under the conditions that the original support is interposed between the surface of the photosensitive material and that of the original, and the original support and the original surface are in close contact with one another (hereinafter referred to as "close contact reflection exposure"), and in which the electrophotographic photosensitive material is wound by a pair of rollers at either end, whereby the projection exposure optical system is eliminated.

An object of this invention is to provide an electrophotographic copying machine which is portable, small in size and weight and low in manufacturing cost.

The foregoing object and other objects of the invention have been achieved by the provision of a small electrophotographic copying machine which, according to the invention, includes an original support made of transparent plastic film; a film-shaped electrophotographic photosensitive material which is wound at both ends thereof, the photosensitive material being subjected to close contact reflection exposure; a charging unit for charging the surface of the photosensitive material; and an exposure unit wherein a surface of the photosensitive material which has been charged is brought into close contact with the rear surface of the original support at at least an exposure region, and wherein the surface of the original which is in contact with the surface of the original support is light-irradiated from behind the photosensitive material, to form the image of the original as an electrostatic latent image on the surface of the photosensitive material.

DETAILED DESCRIPTION OF THE PREFERRED EMBODIMENTS

Figure 1:
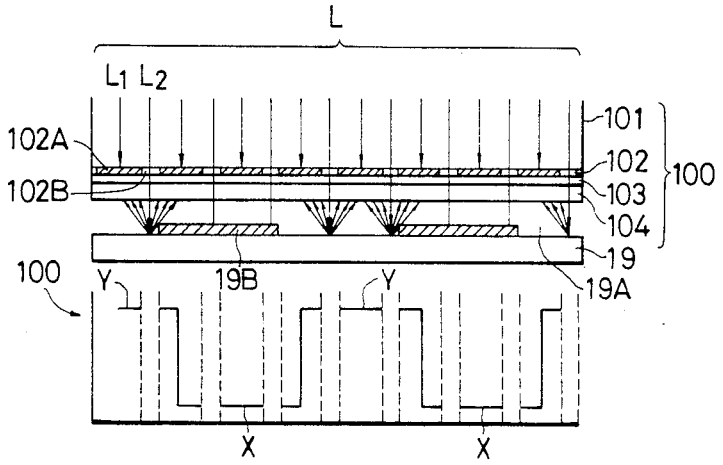
FIG. 1 is an explanatory diagram for describing the operating principles of an electrophotographic photosensitive material employed in this invention.

FIG. 1 is a diagram outlining an electrophotographic photosensitive material employed in the invention, which may be subjected to close contact reflection exposure, and the principle of image formation. The electrophotographic photosensitive material 100, as described in the specification of Published Japanese Patent Application No. 78443/1977 for instance, comprises: a flexible transparent support (such as a plastic film) 101; and a net-shaped opaque layer 102, a light-transmissive conductive layer 103 and a light-transmissive photoconductive layer 104 which are formed on the support 101 in the stated order.

The net-shaped opaque layer 102 is made up of light shielding parts 102A and light transmitting parts 102B. More specifically, the net-shaped opaque layer 102 is such that a number of dot-shaped or stripe-shaped openings are formed as the light transmitting parts. The preferable ratio of the light transmitting parts 102B to the entire opaque layer 102 depends on the pitch of the light transmitting and light shielding parts, charging, exposure conditions employed and the developing method used; however, it should be noted that, as the ratio increases, the obtained image is lowered in contrast. Accordingly, it is desirable that the ratio be as small as possible as the image exposure permits. Thus, it is desirable that the ratio be 50/100 (50%) or less, preferably, 5/100 to 40/100 (5 to 40%). In addition, the pitch of the light transmitting parts and light shielding parts is desirably 50 to 400 lines/inch, and preferably 100 to 200 lines/inch. In the case where an original consisting of a pattern of thick lines is employed, the pitch may be 50 lines/inch or less. The preferred ratio of light, which is active to the photoconductive layer, transiting the light shielding parts to that transiting the light transmitting parts is less than about 30/100 (30%), and more preferably less than about 10/100 (10%).

The light-transmissive conductive layer 103 is formed by vacuum-evaporating tin oxide, indium oxide or copper iodide, or by applying a solution prepared by dispersing particles of the above-described conductive material in a polymer solution, or by other conventional methods.

The light-transmissive photoconductive layer 104 is made of a transparent organic photoconductive material such as poly-N-vinyl carbazole, or a photoconductive powder (such as zinc oxide) resin dispersion layer which is phototransmissive (the layer having a thickness and material selected such that light applied from the side of the support irradiates an original on the photoconductive layer).

The surface of an original 19 consists of white parts 19A and black parts 19B, for instance. The electrophotographic photosensitive material 100, after being uniformly charged, is placed on the original 19 in such a manner that its photoconductive layer 104 is in close contact with the original. Under this condition, the layer 104 is uniformly exposed to a light beam L from the side of the support 101 of the photosensitive material 100. The light beam L reaches the net-shaped opaque layer 102 through the support 101, where a part of the light beam L is absorbed by the light shielding parts 102A, while the remaining light passes through the light transmitting parts 102B.

The light beams L2 which pass through the net-shaped opaque layer 102 pass through the light-transmissive conductive layer 103 and the photo-conductive layer 104 and reach the surface of the original 19. The part of the light L2, which is applied to the white part 19A of the original, is irregularly scattered thereby; and that part which is applied to the black image part 19B is substantially absorbed.

It is assumed that the intensity of the light L2 passing through the photoconductive layer 104 is 100, and that the reflection factors of the white parts 19A and the image parts 19B of the original 19 are 90% and 10%, respectively, when image exposure is carried out. In this case, the photoconductive layer 104 is subjected to image exposure with exposure data as indicated in the graph provided in the lower part cf FIG. 1. That is, the photoconductive layer 104 consists of first parts X which are exposed to light reflected from the black image parts 19B of the original 19 and second parts Y which are exposed to light reflected from the white parts 19A of the original 19 (the exposure data being 90). Let us consider the case where, with the exposure data 90 of the second part Y as a reference level, positive type development or normal development as well known in electrophotography is carried out in which no toner is allowed to stick to the second parts Y, and is allowed to stick to only the first parts X, the exposure data of which is lower than that of the second parts Y. In this case, the black parts are reproduced black as a whole although they may include white dots, while the white parts are reproduced white. Thus, the reproduced image is sufficiently high in contrast.

The operational principles of the photosensitive material employed in the invention are as described above; however, it should be noted that in practice an original support made of a transparent plastic film is inserted between the original and the photosensitive material.

Other examples of electrophotographic photosensitive materials suitable for use in the invention are those disclosed by Published Japanese Patent Application Nos. 109953/1982, 109954/1982, 118288/1982, 120973/1982 and 169752/1982 which work according to the same principle. In addition to the above, any film-shaped electrophotographic photosensitive material which can be subjected to close contact reflection exposure can be used if it can provide sufficiently high contrast, as disclosed, for example, in U.S. Pat. No. 4,314,012; see also U.S. Pat. Nos. 2,917,385 and 3,676,118.

Figure 2:
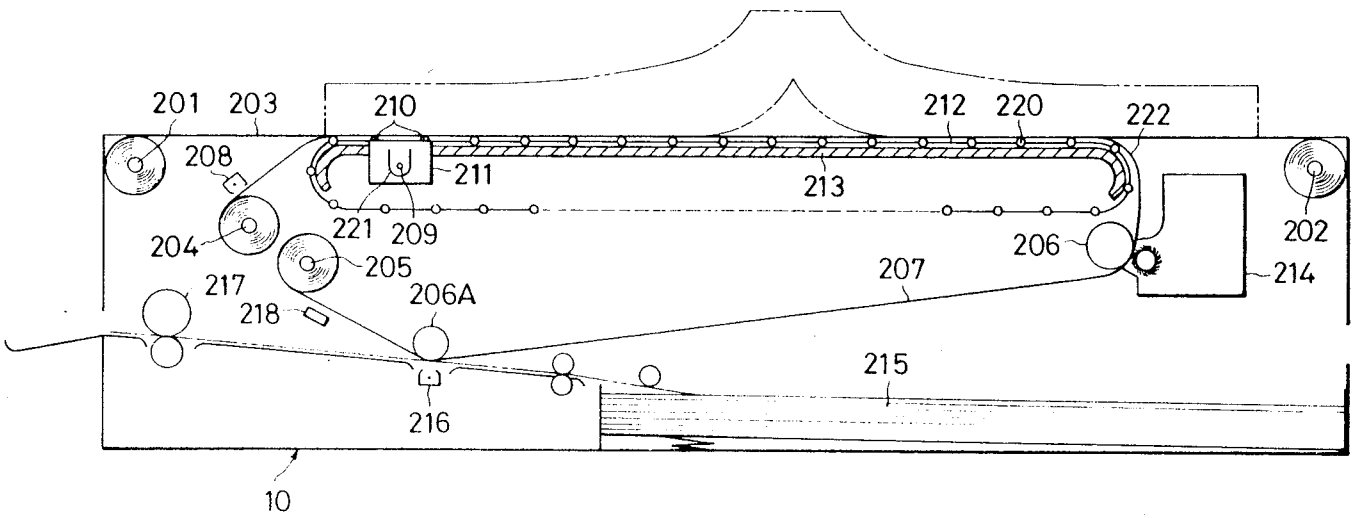
FIGS. 2. through 4*b* explanatory diagrams showing examples of an electrophotographic copying machine according to the invention, in which an original is held at rest during image exposure.

FIG. 2 is a sectional view outlining one example of an electrophotographic copying machine according to the invention which uses the above-described photosensitive material.

In FIG. 2, reference numeral 203 designates a film-shaped original support which is supported and wound by a pair of rollers 201 and 202. The film-shaped support 203 is transparent and the surface thereof which is brought into contact with the photosensitive material is insulated to the extent that the charges of an electrostatic latent image do not leak. Further in FIG. 2, reference numeral 207 designates a film-shaped electrophotographic photosensitive material which can be subjected to close contact reflection exposure as described with reference to FIG. 1. The photosensitive material 207 is supported and wound by a pair of rollers 204 and 205.

A charging unit 208 is provided in order to charge the surface of the photosensitive material. In this example, a corona charging method is employed; however, the invention is not limited thereto or thereby. That is, any conventional charging method such as a friction charging method or a method in which a soft conductive material with a predetermined potential is brought into contact therewith to apply a predetermined potential thereto, may be employed.

An exposure light source is incorporated in a housing 211. The light source is moved along the rear side of the photosensitive material 207 such that, with the original support 203 in close contact with the photosensitive material 207, the original image on the original support is exposed to light. The housing 211 is open at its top surface and has rollers 210 which slide on the rear surface of the photosensitive material. More specifically, the housing 211 incorporates a light source 209 for subjecting the photosensitive material 207 to exposure and a reflecting mirror 221. If the inner surfaces of the housing 211 is plated with chromium, i.e., if the housing is employed as a reflecting mirror, then the reflecting mirror 221 may be omitted.

A connecting member 212 is connected to the housing 211 at both ends, so as to form a loop which supports the original support 203 and the photosensitive material 207. Bar-shaped members 220 made of thin metal rods which are hard enough to support an original on the original support are arranged on the connecting member at equal intervals. The bar-shaped members may be covered with a plastic film. A guide rail 213 is fixedly provided inside the copying machine. The connecting member 212 with the bar-shaped members 220 and both end portions of the housing 211 slide on the guide rail 213, to support the original support 203 and the photosensitive material 207 at all times.

A developing unit 214 is provided adjacent to a guide roller 206, so as to subject to toner development the surface of the photosensitive material on which the electrostatic image has been formed. For instance, a conventional developing method such as a one-component magnetic brush developing method, a two-component magnetic brush developing method or a liquid developing method may be employed. Furthermore, either a normal developing method in which toner is applied to the parts of the material having the charges, or a reversal development method wherein toner is applied to parts having no or almost no charge may be employed.

Further in FIG. 2, reference numeral 216 designates a transfer unit for transferring the toner image formed on the photosensitive material 207 to a transfer medium. Conventional transferring methods such as a corona charging transfer method or a voltage application method using a contact electrode may be employed. Reference numeral 206A designates a guide roller for holding the photosensitive material 207, which has the toner image on its surface, in place in the transfer unit 216. Reference numeral 215 designates a transfer medium supplying section for supplying the transfer medium to the unit 216. Reference numeral 217 designates a fixing unit for fixing the toner image transferred. In this case, conventional fixing methods such as a thermal fixing method or a pressure fixing method may be employed. Reference numeral 218 designates a cleaning unit for removing the toner from the surface of the photosensitive material 207 after transfer of the toner image. In this case, conventional cleaning methods such as brush cleaning, a blade cleaning method or a web cleaning method may be employed.

The operation of the copying machine thus constructed will now be described.

The film-shaped original support 203 and the film-shaped electrophotographic photosensitive material 207 are held by the housing 211 incorporating the exposure light source and the loop-shaped connecting member 212. Prior to the start of a copying operation, the housing is positioned at one end (the left end in FIG. 2). When a copy switch (not shown) is turned on after an original is set in place, a voltage is applied to the charging unit 208 while the rollers 204 and 205 supporting the photosensitive material are turned, so that a predetermined surface area of the photosensitive material is charged corresponding to a predetermined original size. The charged part of the photosensitive material 207, which is transported integrally with the original support 203, is delivered until it comes below the surface of the original, and the rollers 204 and 205 are stopped to hold the photosensitive material 207 at rest. During this period, the photosensitive material moves along the rollers 210 of the housing 211, which is at rest, and the connecting member 212.

When the charging unit is deenergized, the light source 221 is turned on, and the housing 211 starts sliding on the guide rail 213 toward the other end (the right end in FIG. 2). As a result, light is applied to the surface of the original, which is in contact with the original support, from behind the photosensitive material, thus forming an electrostatic latent image on the surface of the photosensitive material.

When the entire surface of the original has been irradiated by light in this way, the housing 211 and the connecting member 212 are stopped, accomplishing the exposure process.

The surface of the photosensitive material on which the latent image has been formed is delivered to the developing unit 214 via the rollers 204 and 205 supporting the photosensitive material, where it is subjected to toner development, for instance, according to a magnetic brush development method.

The rollers 204 and 205 are further turned to deliver the photosensitive material thus developed to the transfer unit 216. The toner image formed on the photosensitive material is transferred, onto a transfer medium which is supplied by the transfer medium supplying section 215, for instance, according to a corona discharging method. The transfer medium onto which the toner image has been transferred is delivered to the fixing unit 217, where it is subjected to thermal fixing, for instance, and is then discharged from the copying machine. The toner particles which have been left on the photosensitive material after the transfer process are removed by a conventional method after, for example, being neutralized by corona discharge or light exposure. At this instant, or immediately after the exposure process, or during the copying process, tne housing 211 which is at rest at the right end (in the case of FIG. 2) is returned to its original position (by moving it to the left).

The photosensitive material, from which the toner particles have been removed by the cleaning unit, is held at rest until the next copying process is started. When the next copying operation starts, the photosensitive material is again conveyed in the same direction. Finally, the entire length of the photosensitive material is wound on the roller 205, whereupon the rollers 204 and 205 are turned in the opposite direction, so that the photosensitive material is wound on the roller 204. The copying machine may be designed so that, whenever one copying cycle has been accomplished, the photosensitive material is returned to its original position. In this case, when the photosensitive material is deteriorated and/or when a predetermined number of copies have been made, the photosensitive material is wound by a distance of one frame or a predetermined length to provide a new (unused) part for copying. The photosensitive material may be in the form of an endless belt. Furthermore, the copying machine may be modified so that the belt-shaped original support 203 is supported by the rollers 201 and 202 in such a manner that, whenever the original support 203 is scratched, the rollers 201 and 212 are turned to move the original support to use a new part thereof. The film-shaped original support may be tightened under tension over a stationary frame.

As is apparent from the above-described example, some of the specific features of the invention reside in that the film-shaped original support supports and/or conveys the original, the surface of the original is not directly in contact with the surface of the photosensitive material and the photosensitive material is arranged to be wound at both ends thereof. Owing to these features, the drawback attributed to the fact that the surface of the original directly contacts the photosensitive material surface is eliminated, and the weight and size of the copying machine is also reduced as compared to that of U.S. Pat. No. 3,676,118.

In general, originals such as documents are electrically conductive when the humidity is high. Therefore, when such an original is brought into direct contact with the photosensitive layer, the charges of the electrostatic latent image leak, as a result of which the latent image is deteriorated. Furthermore, when an original is brought in direct contact with the photosensitive layer, the latter is liable to be scratched. However, the original support of the invention disposed therebetween serves as a protective layer which protects the photosensitive layer from being scratched. Furthermore, since the photosensitive material is arranged so as to be wound by rollers at both ends, the copying machine can be made light in weight and small in size.

By increasing the thickness of the film-shaped original support, the original supporting and conveying performance and the photosensitive layer protection characteristic are improved, but copy resolution is lowered. Accordingly, the film thickness is important, being 15 to 200 μm in practice and preferably 25 to 100 μm. The size and weight of the copying machine of the present invention is greatly reduced partly because the film-shaped electrophotographic material is wound by a pair of rollers at either end, improving over the disadvantageous technique of U.S. Pat. No. 3,676,118.

Figure 3:
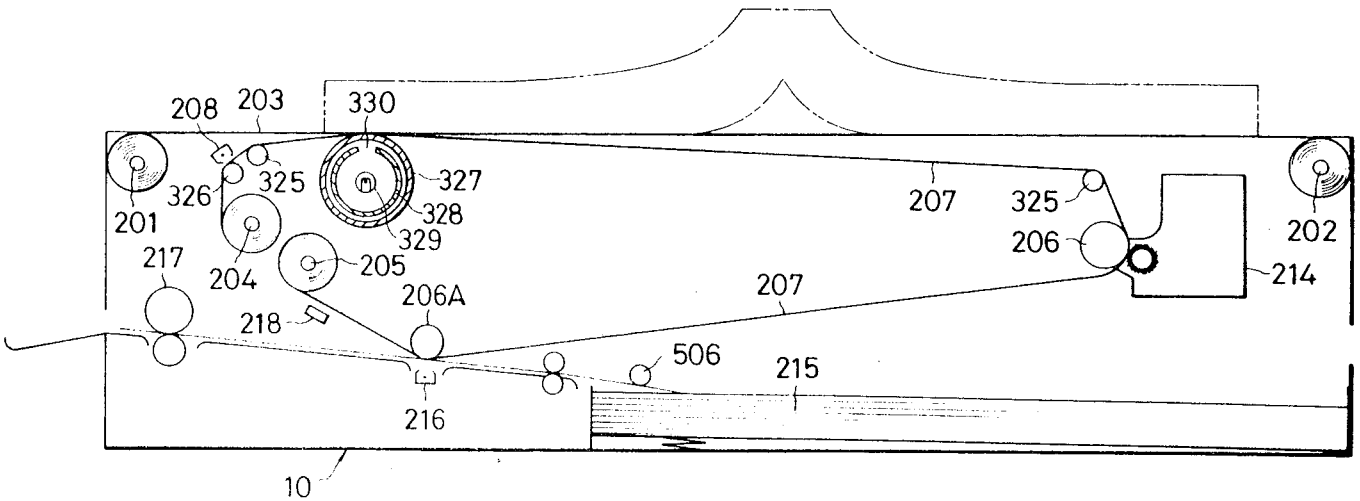

FIGS. 3 and 4 show further examples of the copying machine according to the invention. In these figures, those elements described with reference to FIG. 2 are therefore similarly numbered and a detailed description thereof will be omitted.

In the second example, in order to bring the original support 203 into close contact with the photosensitive material 207, instead of the connecting member 212, guide rolls 325 are provided; and instead of the housing 211 incorporating the exposure light source, a transparent rotary cylinder 327 is provided. A stationary reflecting mirror 328 having a slit 330, and an exposure light source 329 are provided inside the transparent cylinder 327. During exposure, the transparent cylinder 327 is moved to the right while turning counterclockwise. In the step of moving the photosensitive material after exposure, the transparent cylinder in contact with the photosensitive material may then be turned in the opposite direction or may be held fixed. In the latter case, the rear side of the photosensitive material slides on the transparent cylinder 327. The transparent cylinder 327 may be made of glass, quartz, heat-resistant glass or plastic. Alternatively, a top portion of the cylinder may be made transparent. The cylinder is then not rotated. That is, the original support 203 moves slidingly on the cylinder 327, or the cylinder 327 moves slidingly under the original support 203 as stated above.

The mechanism for bringing the original support 203 into close contact with the photosensitive material 207 is simpler than that of the first example. In the case where the cylinder is moved while turning, the rear surface of the photosensitive material is not rubbed thereby, which increases the service life thereof. Furthermore, as the original support 203 and the photosensitive material 207 are supported in a region including the generating line of the cylinder 327, the former can be brought into satisfactory contact with the latter.

In the second example, the guide rolls 325 are used in order to bring the original support 203 into close contact with the photosensitive material 207. However, the copying machine may be modified so that another guide roll 326 is provided adjacent to the winding roll 204. In this modification, irrespective of an increase or decrease in the film-shaped electrophotographic photosensitive material 207 on the winding roll 204, the distance between the charging unit 208 and the surface of the photosensitive material 207 is maintained unchanged, and accordingly the charging condition is uniformly maintained at all times.

Figure 4A:
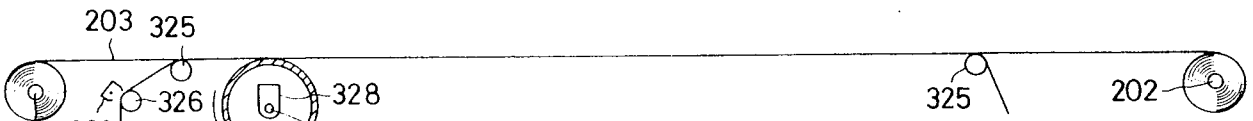
FIGS. 4*c* and 4*d* are explanatory diagrams showing examples of a planar light source.
Figure 4B:
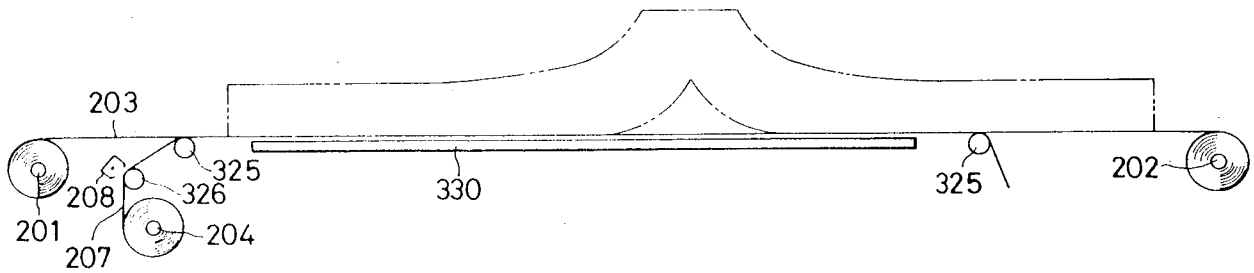
Figure 4D:
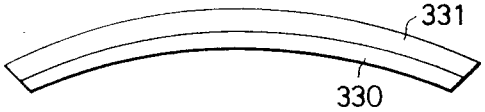
Figure 4C:
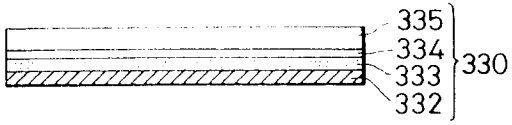

FIG. 4*a* shows a third example of the copying machine according to the invention, in which the contact area between the film-shaped original support 203 and the film-shaped electrophotographic photosensitive material 207 is increased (larger than the area of an original). In an application of the example shown in FIG. 4*a*, the copying machine may be designed so that a planar light source 330 is employed as shown in FIG. 4*b*. The planar light source 330 may be an electroluminescence type light panel. The light panel, as shown in FIG. 4*c*, comprises a conductive rear plate 332, a phosphorlayer 333, a transparent conductive layer 334, and a transparent insulting layer 335 which acts as a protective layer. The brightness is controlled by changing the voltage and/or the frequency of the electric power applied to the phosphorlayer. It is desirable that the size thereof be equal to or larger than the copying surface of an original. In the case where an original is relatively heavy, i.e., where it cannot be sufficiently supported by the original support, a light panel 330 is formed on the rear surface of a transparent plate 331 such as a glass plate or an acrylic resin plate which is curved as shown in FIG. 4*d*, and the heavy original is placed through the photosensitive material and the original support on the assembly of the transparent plate 331 and the light panel 330. In this case, relatively high strength can be obtained by the use of light panel and transparent plate which are relatively thin. In order to ensure that the rear surface of the photosensitive material slides well on the front surface of the transparent plate 331, the surface of the plate 331 may be covered with a film of material such as ethylene tetrafluoride resin which has an extremely low coefficient of friction. Furthermore, in order to ensure that the electrophotographic photosensitive material is brought positively into close contact with the copying surface of the original, it is preferable that a sheet-shaped member of soft rubber for instance, which is of excellent flexibility, be placed on the original.

In the case where the transparent plate 331 is made of a plastic plate, electrostatic charge is generated by friction between the surfaces of the plastic member and the rear surface of the photosensitive material 207, so that sometimes the photosensitive material 207 cannot smoothly slide on the plastic member. This difficulty may be eliminated by providing an electrically conductive layer on the surface of the light panel 330 or the transparent plate 331 or the rear surface of the electrophotographic material.

The transparent conductive layer may be formed by vacuum-evaporating conductive material such as tin oxide, indium oxide or copper iodide or by applying a solution which is prepared by dispersing particles of the above-described conductive material in a polymer solution.

In the above-described electrophotographic copying machine, a planar light source according to the electroluminescence principle is employed for the exposure process, and the planar light source is fixed so that the original and the photosensitive material which are set at the exposure position and in close contact with one another are subjected to exposure simultaneously. Therefore, it is unnecessary to provide means for driving the light source and the original, or to provide particular electrical connecting means, or to provide means for accurately synchronizing the original and the photosensitive material with each other. According to the third example, the copying machine mechanism can thus be simplified. The examples shown in FIGS. 3 through 4*d* are the more-preferred ones of the present invention.

In the above-described examples of the small electrophotographic copying machine according to the invention, exposure is carried out with the original held at rest. Small electrophotographic copying machines of the type where exposure is carried out with the original being moved will be described with reference to FIGS. 5 through FIG. 9*b*.

Figure 5:
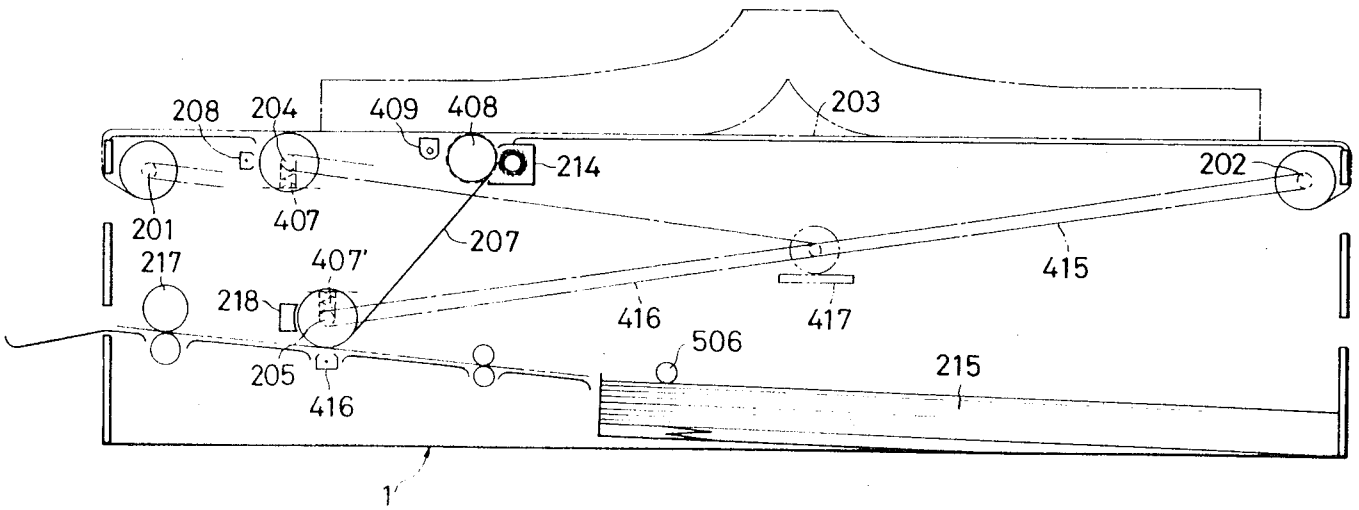

FIG. 5 shows one example of such a copying machine. In FIG. 5, those components previously descibed with reference to the above-described examples are similarly numbered, and a detailed description thereof will be omitted.

Figure 7:
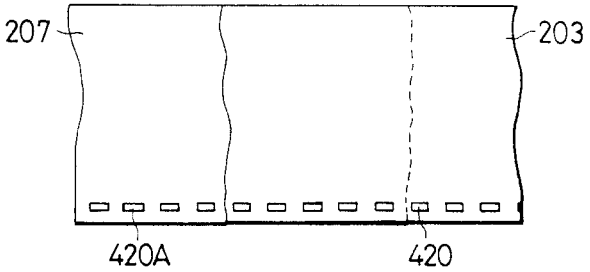

In FIG. 5, reference numeral 203 designates a film-shaped original support which is wound on and supported by a pair of rollers 201 and 202 similarly to the above-described examples. The original support 203 is transparent, and the surface thereof brought in contact with a photosensitive material is electrically insulated to the extent that the charges of the electrostatic latent image do not leak. The original support 203 has perforations 420 along at least one edge thereof as shown in FIG. 7. Further in FIG. 5, reference numeral 207 designates a film-shaped electrophotographic photosensitive material which can be subjected to close contact reflection exposure, similarly as in the case of FIG. 1. The photosensitive material 207 is wound on and supported by a pair of rollers 204 and 205. The photosensitive material 207 also has perforations 420A along at least one edge thereof at the same interval as the perforations 420, as shown in FIG. 7.

The above-described roller 204 is disposed adjacent to the original support 203. The roller 204 is urged by means of a spring 407 towards the original support 203 so that it is in contact with the support 203 at all times, irrespective of an increase or decrease in the film-shaped photosensitive material 207 on the roller 204, and such that the photoconductive layer is in close contact with the original support 203 between the roller 204 and a guide roller 408. On the other hand, the roller 205 is urged by means of spring 407' towards a transfer unit 412 so that it satisfactorily confronts the transfer unit 412 irrespective of an increase or decrease in the photosensitive material 207 on the roll 205.

Figure 6A:
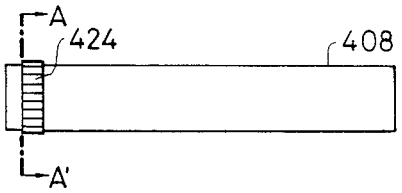
FIGS. 5 through 8*b* are explanatory diagrams showing examples of an electrophotographic copying machine according to the invention, in which the original is moved during image exposure.
Figure 6B:
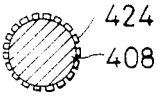

The guide roller 408 has a sprocket 424 at one end as shown in FIGS. 6*a* and 6*b*, which engages the perforations 420 and 420A of the original support 203 and the photosensitive material 207 so as to convey the same in a synchronous manner, as shown in FIG. 7. The sprocket 424 may be made of metal and grounded. In this case, the conductive layer of the photosensitive material 207 can readily be grounded through sprocket 424. The rollers 201 and 202 supporting the original support 203 and the rollers 204 and 205 supporting the photosensitive material 207 are rotated through belts 415 and 416 by an electric motor 417.

A light source 409 is provided for subjecting the photosensitive material 207 in close contact with the original support to exposure from behind. The light source 409 may be set at any position where it can subject the sensitive material 207 to exposure while in close contact with the original support 203. If the guide roller 408 is transparent as in the above-described example, the light source 409 may be incorporated in the guide roller 408.

The operation of the copying machine thus constructed will now be described.

A copying switch (not shown) is turned on after an original is placed on the original support 203. As a result, a high voltage is applied to the charging unit 208, and the surface of the photosensitive material is corona-charged. At the same time, the motor 417 is driven, so that the rollers 201 and 202 supporting the original support 203 and the rollers 204 and 205 supporting the photosensitive material 207 are rotated. Accordingly, the original support 203 and the photosensitive material 207 are synchronously moved to the exposure position, with the sprocket 424 on the guide roller 408 engaged with the perforations 420 and 420A of the original support 203 and the photosensitive material 207. Light from the light source 409 disposed behind the photosensitive material is applied to the original and is reflected therefrom. As a result, the photosensitive material conveyed to the exposure position is subjected to exposure by the light through the original support, whereby an electrostatic latent image is formed on the photoconductive layer. The photoconductive material, on which the electrostatic latent image has been formed, is moved to the developing unit 214, where it is subjected to toner development, for instance, according to a magnetic brush developing method. The photoconductive material thus treated is moved to the transfer unit 412, where the image thus developed is transferred onto a transfer medium supplied thereto. The original support 203 is conveyed in synchronization with the photosensitive material until the end of the developed toner image passes through the transfer unit, or until the image transfer operation is accomplished. The toner image transferred onto the transfer medium is subjected to fixing in the fixing unit 217, and the medium is discharged from the copying machine. On the other hand, the photosensitive material is conveyed to the cleaning unit 218, where the remaining toner particles are removed therefrom. Thus, one copying cycle is accomplished.

In the above-described example, the original support, on which the original is placed, is conveyed synchronously with the photosensitive material until the toner image is transferred in each copying cycle, and after the entire lengths of the original support and the photosensitive material have been wound in one direction, they are synchronously rewound. However, the copying machine may be designed so that, when the end of the original has been exposed, the original support is rewound on the roller 201 independently of the photosensitive material so that it returns to its original position. Furthermore, the copying machine may be designed so that the photosensitive material and the original support are run synchronously until one copying cycle is accomplished, and are then both returned to their original positions. In the latter case, when the photosensitive material or the original support becomes scratched and/or when a predetermined number of copies are printed, the photosensitive material and/or the original support may be wound as much as one frame or a predetermined length to provide new portions for subsequent use.

Figure 8D:
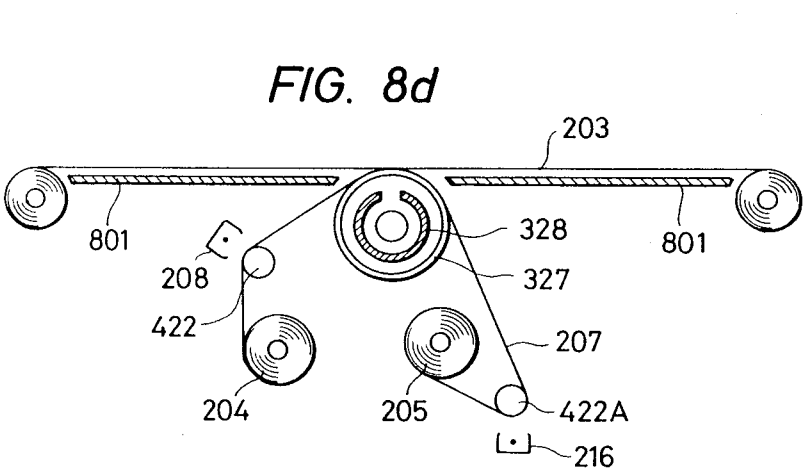
FIGS. 8*c* and 8*d* are explanatory diagrams showing light intercepting means provided in the copying machines shown in FIGS. 8*a* and 8*d*, respectively.
Figure 8C:
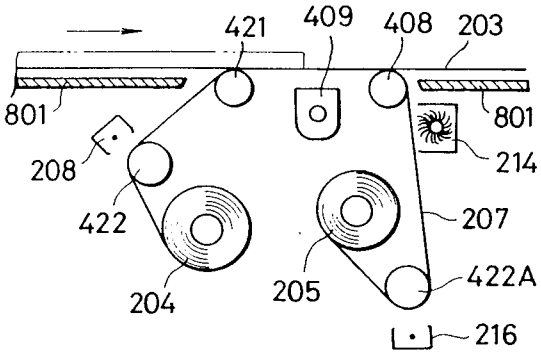
Figure 8A:
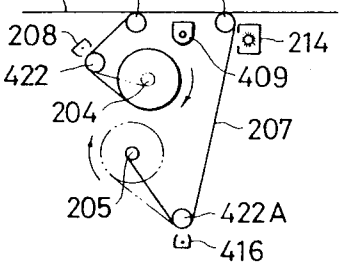
Figure 8B:
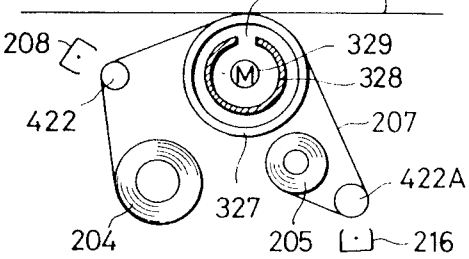

FIGS. 8*a* and 8*b* show modifications of the electrophotographic copying machine of FIG. 5.

In the modification shown in FIG. 8*a*, instead of the means for bringing the original support 203 into close contact with the photosensitive material 207 as was described with reference to FIG. 5, i.e., the winding roll energizing means 407, a guide roll 421 is provided in order to bring the photosensitive material into close contact with the original support and a guide roll 422 is further provided in order to maintain the distance between the photosensitive material 207 and the charging unit 208 constant. In this case, the winding roll energizing means 407 for correcting for the increase or decrease of the film-shaped photosensitive material on the winding roll 204 can be eliminated.

In the modification shown in FIG. 8*b*, a roller 422A is provided so that the photosensitive material 207 is held in place in the transfer unit 412. In this case, the energizing means 407 for the winding roller 205 can be eliminated from the transfer unit 412. A modification of FIG. 8*a* is shown in FIG. 8*b*. The light source 329 is incorporated in the transparent cylinder 327. In this case, the transparent cylinder 327 supports the original support 203. Therefore, rollers 408 and 421 in FIG. 8*a* are not necessary.

In the above-described copying machines, an electrostatic latent image formed by exposure to the light source 209, 329 or 409 is subjected to toner development by the developing unit 214, and the resultant toner image is transferred by the transfer unit 216 or 412; however, the invention is not limited thereto or thereby, and the so-called "Transfer of electrostatic latent image" method (TESI method) can be employed. In this case, the developing unit 214 is eliminated, an electrostatic latent image formed on the photosensitive material is transferred onto the transfer medium by the transfer unit, and a developing unit is additionally provided to develop the electrostatic latent image transferred onto the transfer medium.

The above-described original-movement type small electrophotographic copying machine can be disadvantageous in a case where an original cannot be covered with the original cover or where an original is copied without the original cover and is smaller than the exposure region such that the electrophotographic photosensitive material may be exposed to external light. Therefore, it is desirable to provide a light intercepting member above the photosensitive material except for the exposure region, in order to intercept external light.

In FIG. 8*c*, a light intercepting plate 801 is provided below the original support 203, to cover the left-hand side of the roller 421 and the right-hand side of the roller 408.

FIG. 8*d* shows an example of a copying machine which employs a rotary transparent cylinder 327. In this case, the light intercepting plate 801 is provided in such manner that it is below the original support 203 and is set close to the cylinder 327 but not in contact with the photosensitive material 207 on the cylinder 327.

The light intercepting plate in FIGS. 8*c* or 8*d* can serve as a guide plate for holding the original support 203.

Figure 9A:
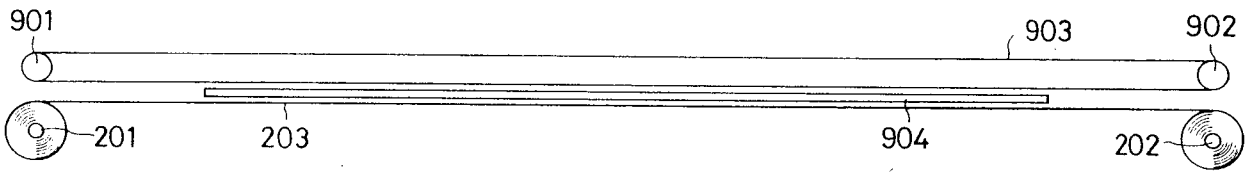
FIGS. 9*a* through 9*e* are explanatory diagrams showing examples of an original retainer which is employed in the copying machine of the invention.
Figure 9B:
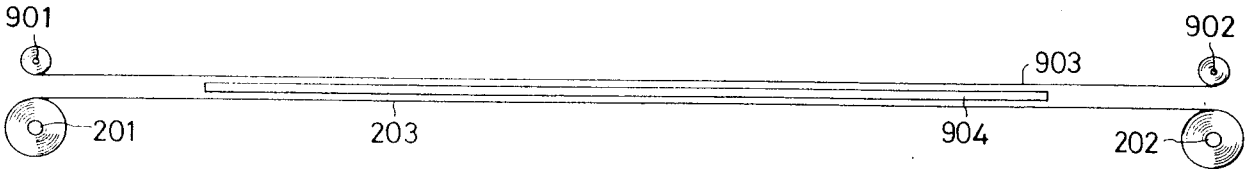

FIGS. 9*a* and 9*b* shows examples of a copying machine in which, where the original is in the form of a sheet or a thin book, an original retainer serving as an original conveying means is provided over the original support.

In the example shown in FIG. 9*a*, in order to automatically convey a sheet-shaped original 904 to the exposure position, there are provided a pair of rolls 901 and 902 which operate in synchronization with the rolls 201 and 202 of the film-shaped original support 203, and a flexible, endless-belt-shaped original retainer 903 which is laid over the rollers 901 and 902 and moves integrally with the original support 203 and the sheet-shaped original 904. The original retainer 903 may be made of a flexible material such as a plastic film, a plastic film reinforced with cloth, a rubber sheet or paper or the like; however, the material should not generate a triboelectric charge between the original and the original support. It is preferable to fabricate the original retainer 903 of a light intercepting material, because it can then protect the photosensitive material from external light.

In the example shown in FIG. 9*b*, instead of the endless-belt-shaped original retainer of FIG. 9*a*, an elongated original retainer is employed. The retainer 903 is taken up on the roller 901 or 902. As the original support 203 is moved right in FIG. 9*b*, the retainer 903 is synchronously moved to the right, thus being wound on the roll 902 from the roll 901. Similarly, as the original support 903 is moved leftwardly, the original retainer 903 is also moved to the left, thus being wound on the roll 901.

Figure 9C:
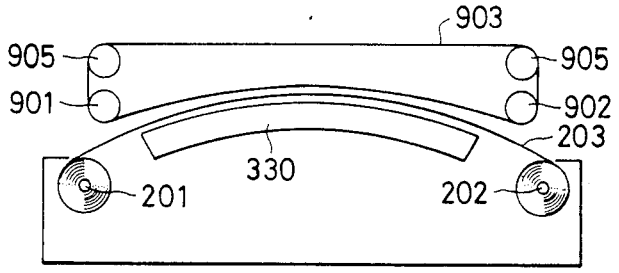

In the case of FIG. 9*c*, the original holding stage is arcuate. In this case, the retainer 903 is laid over four rollers 901, 902, 905 and 905.

Figure 9D:
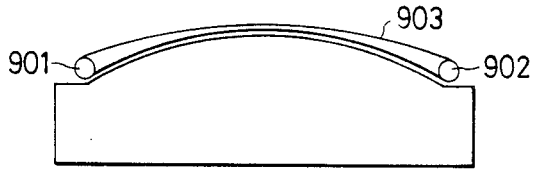

In the case of FIG. 9*d*, the original holding stage is arcuate and the cover 903 is laid over two rollers 901 and 902. In the case of FIGS. 9*c* and 9*d*, the original cover 903 strongly pushes the entire surface of the original holding stage, providing good contact between the original and the original support. The examples of FIGS. 9*c* and 9*d* are especially excellent examples of the copying machine of the present invention.

Figure 9E:
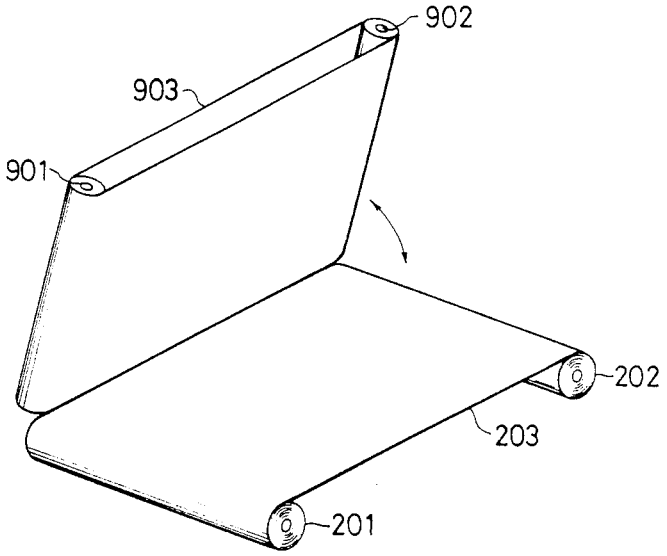

In any one of the above-described cases (FIGS. 9*a* through 9*d*), the copying machine may be modified so that the original retainer may be swung about one edge as shown in FIG. 9*e*. In this case, a relatively thick book can be copied.

Figure 10:
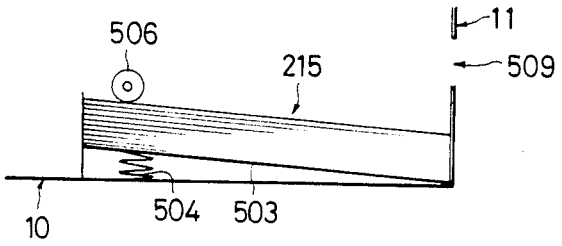
FIGS. 10 through 12 are diagrams showing a transfer sheet containing section of the copying machine according to the invention.
Figure 12:
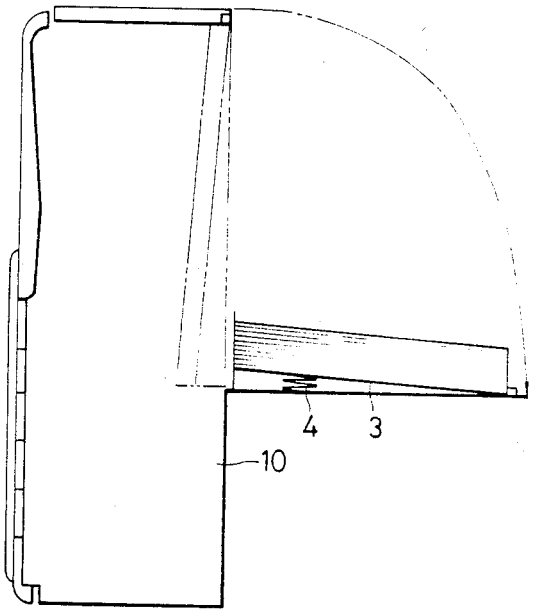
Figure 11:
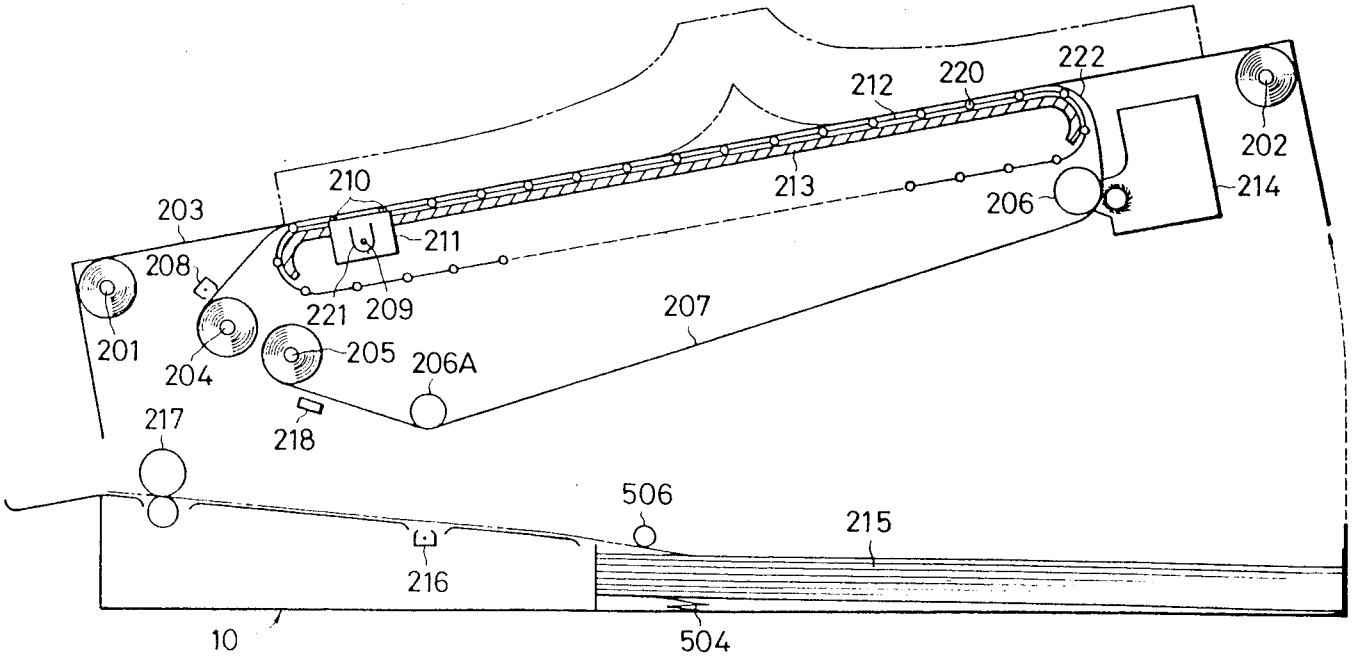

FIGS. 10 through 12 show examples of the transfer sheet containing unit (hereinafter referred to as a cassette when applicable) employed in the copying machine according to the invention.

The cassette is combined with the copying machine body such that the bottom plate of the cassette forms a part of the bottom of the copying machine housing to achieve a reduction in weight and size. When it is required to supplement the transfer sheets, the copying machine body is held as it is, or the copying machine body or a part of the bottom plate is opened to load transfer sheets into the cassette.

In a conventional copying machine, the cassette is provided independently of the copying machine body. Therefore, when it is required to supplement the transfer sheets, the cassette is withdrawn from the copying machine, transfer sheets are put in the cassette thus withdrawn, and the cassette is inserted into the copying machine. On the other hand, in the invention, the cassette is not handled independently of the copying machine and accordingly the cassette may be low in mechanical strength. Therefore, an increase in weight due to the need of a strong cassette can be avoided, according to the invention. Furthermore, it is unnecessary to form a cassette receiving portion in the copying machine body, which makes it possible to greatly reduce the weight and size.

As is apparent from FIGS. 10 through 12, a cassette 215 is integrally provided inside the copying machine body 10. The bottom plate of the cassette 215 serves as the bottom plate of the copying machine body. When it is required to supplement the transfer sheets in the cassette, a stack of transfer sheets is supplied thereinto through an opening 509 in the side of the copying machine body. In this case, the stack of transfer sheets is loaded with a hard thin plate or the like placed thereon, and the thin plate is then removed, so that the transfer sheets can be loaded without being obstructed by the sheet supplying roll 506 which is placed on the transfer sheets under pressure. The transfer sheets thus loaded in the sheet containing unit are held in a manner such that one edge thereof is flush with the upper edge of the sheet containing unit. As the sheet supplying roll 506 turns, one sheet is conveyed to the transfer unit 216, where it is subjected to image transfer. Thereafter, the sheet is conveyed to the fixing unit 217 and is then discharged from the copying machine.

FIGS. 11 and 12 show examples of the transfer sheet containing unit into which transfer sheets can be readily loaded especially when the sheets should be supplemented. In the example shown in FIG. 11, a so-called "alligator mechanism" is employed so that the copying machine is opened vertically with the sheet containing unit as the fulcrum. In the case of FIG. 12, the copying machine is stood up and the bottom plate of the transfer sheet containing unit, which is a part of the bottom of the copying machine, is opened, in order to supplement the sheets. Shown in FIGS. 11 and 12 are especially excellent ones of the examples of the copying machine according to the invention. The example shown in FIG. 10 may be modified so that the sheet supplying roll 506 is retracted upwardly in supplementing the transfer sheets. In addition, a conventional arcuate sheet supplying roll may be employed.

One example of the fixing unit of the invention will be described with reference to FIGS. 13 and 14.

Figure 13:
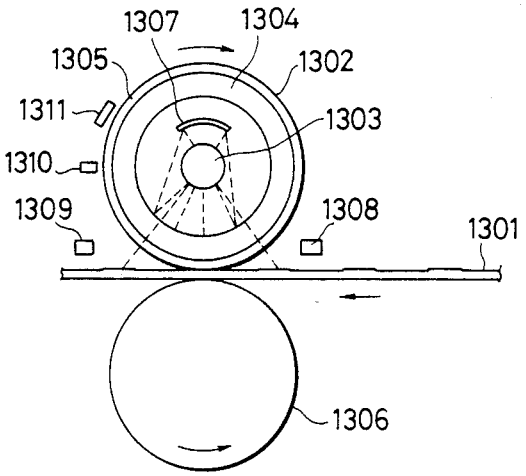
FIGS. 13 and 14 are explanatory diagrams showing examples of a fixing unit of the copying machine of the invention.

In FIG. 13, a transfer medium 1301, on which a toner image has been formed, passes through a fixing drum 1302 and a backing roller 1306 which turns together with the drum 1302; that is, the transfer medium 1301 is subjected to fixing. The roller 1306 is intended to apply a small pressure to the transfer medium 1301 and to facilitate conveyance of the medium 1301. The roller 1306 is made of metal or plastic, or of metal covered with rubber or plastic. It is preferable that the roller be covered with silicone or polyethylene fluoride.

When the transfer medium 1301 is conveyed to the fixing drum and the backing roller 1306 such that the surface of the transfer medium on which the image has been formed confronts the fixing drum, an infrared ray and/or visible ray generating element such as a tungsten lamp in the fixing drum is turned on, so that the infrared rays and/or visible rays instantaneously heat a light absorbing layer 1305 on the surface of the fixing drum through a heat-resistant glass layer 1304 which absorbs no light, being transparent.

One example of the light absorbing layer 1305 is a glass ink layer of 0.1 to 0.5 mm in thickness having a melting point of 300° to 400° C., which is prepared by kneading coloring pigment such as carbon black or iron oxide with glass particles and coaring the mixture on the glass cylinder 1304, and then sintering. Alternatively, the light absorbing layer may be a durable light absorbing film of 500 to 2000 Å in thickness formed by vacuum-evaporating metal such as chromium, nickel, tantalum, or molybdenum, or oxides or alloys of these metals. It is desirable that the light absorbing layer 1305 be covered with a thin release layer of fluoropolymer, silicone for instance) or be brought into contact with a pad 1311 impregnated by silicone oil so as to have a thin silicone oil layer, to thereby have a mold release effect. It is most preferable that the light absorbing layer 1305 be made of light absorbing polyethylene fluoride (for instance "Teflon" kneaded with carbon, the term "Teflon" being the trade name of a fluororesin manufactured by Dupont) or silicone resin, because the mold release effect is more effectively improved.

The light absorbing layer 1305 absorbs the larger part of the infrared rays and/or visible rays (the light transmittance being about 30% or less).

A light emitting element 1303 for emitting infrared rays and/or visible rays and a reflecting mirror having a surface such as Au, Ag, Pt or Al of a high reflection factor may be arranged inside the fixing drum 1302. The light emitting element 1301 is, for example, is a bar-shaped lamp about 4 to 8 mm in diameter having a tungsten filament. The light emitting element irradiates the transfer medium 1301 for the time interval which elapses from slightly before the time instant the transfer medium reaches the fixing unit until it passes through the fixing unit. However, in the case where transfer media 1301 are successively conveyed to the fixing unit, the surface temperature of the fixing drum 1302 is increased. Therefore, in this case, a temperature sensor 1310 may be provided so that the light emitting element is operated intermittently.

Further in FIG. 13, reference numeral 1308 designates a transfer medium detector for detecting when the medium 1301 reaches the fixing unit, to operate the light emitting element 1303, and reference numeral 1309 designates a detector for detecting when the medium 1301 leaves the fixing unit, to deenergize the light emitting element 1303. The detectors 1308 and 1309 may be micro-switches or photo-sensors.

These detectors output detection signals as indicated; however, these detection signals may be replaced by signals from a copying start switch (not shown) provided on the copying machine body. In other words, the copying machine may be designed so that the light emitting element 1303 is energized a predetermined period of time after the copying start signal is output, and is deenergized a predetermined period of time thereafter.

Figure 14:
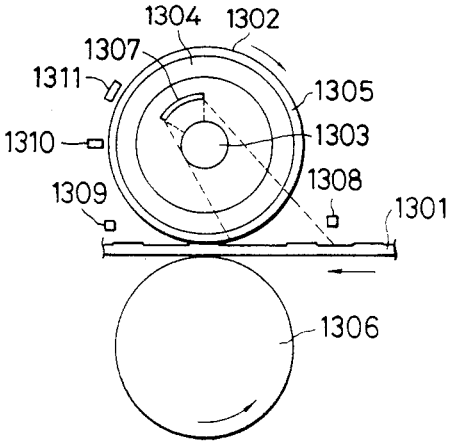

FIG. 14 shows one modification of the fixing unit shown in FIG. 13. In this modification, the reflecting mirror 1307 is displaced so that preheating of the transfer medium 1301 conveyed to the fixing unit is improved.

In the fixing unit of FIGS. 13 or 14, thermal fixing is carried out according to a method in which light hits the light absorbing layer 1305 so that the fixing drum 1302 is instantaneously heated. In this thermal fixing method, drawbacks of the heat roller system are eliminated while the advantages of a radiation heat system are utilized. Accordingly, even an image of thin lines or an image of low density can be satisfactorily fixed. Furthermore, even when the transfer medium is jammed in the fixing unit, fire is not caused, because the thermal capacity is so small that the heat is absorbed by the transfer medium and accordingly the temperature is decreased immediately. In addition, as the thermal capacity is small, an electro photographic fixing unit of the low power type in which it is unnecessary to maintain a given fixing temperature at all times, can be provided according to the invention.

Figure 15A:
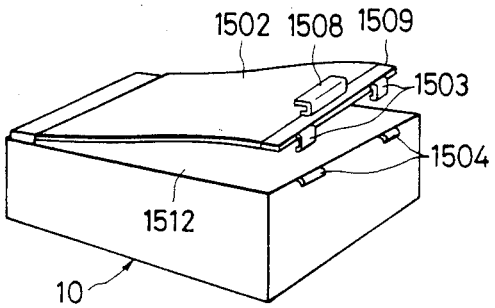
FIGS. 15*a* through 15*d* are diagrams showing examples of an original retainer of the copying machine of the invention.
Figure 15B:
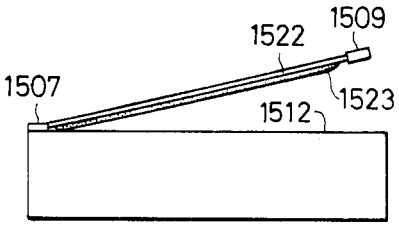

According to another aspect of this invention, an original retainer as shown in FIG. 15*a* or 15*b* is used to fixedly hold an original on the original support.

In FIG. 15*a*, the original retainer 1502 is a flexible, stretchable, thin sheet member. The original retainer 1502 is coupled to the copying machine body at one end, and has a handle 1508 at the other end. The original retainer 1502 further has a hard member 1509 which is integral with the handle and is used to impart uniform tension to the original retainer 1502. The hard member 1509 has two hooks 1503 near either end. On the other hand, the copying machine body has two holding members, namely, hooks which are engaged with the aforementioned hooks 1503, respectively. In the case of FIG. 15*a*, the original retainer 1502 is made of a stretchable rubber film. Examples of suitable materials for the original retainer 1502 are styrene-butadiene rubber (SBR), butadiene rubber (BR), isoprene rubber (IR), ethylene propyrene rubber and urethane rubber. An elastic net-shaped member may be employed as the original retainer. The hard member at the end of the original retainer is for applying uniform tension to the original retainer and serves as a reinforcing member for the hooks. Therefore, the hard member may be made of any material which is equivalent in hardness to hard plastic. In the above-described example, the handle 1502 is integral with the hard member 1509; however, the invention is not limited thereto or thereby.

The operation of the original retainer will now be described.

The original retainer 1502 is opened. An original, which is, for instance, relatively thick, is placed on an original placing stage 1512 with its surface facing downwardly. Then, the original is covered with the retainer 1502. While the retainer 1502 is pulled horizontally (to the right-hand side), the hooks 1503 on the hard member 1509 at the end of the retainer are engaged with the hooks 1504 on the copying machine body. The original is sufficiently depressed by the retainer thus pulled. Accordingly, as the thickness of the original is increased, the tension is increased to bring the original into close contact with the photosensitive material. After a series of copying steps have been achieved, the hooks are disengaged and the original retainer is raised, to remove the original from the copying machine. With the original retainer shown in FIG. 15*a*, as the thickness of the original is increased, the depression force applied thereto is increased and the original is sufficiently brought into contact with the photosensitive surface, as described above; that is, the original retainer operates more satisfactorily in this case. The surface of the retainer which confronts the original is coated white in order to reflect light. Alternatively, the original retainer itself may be made of white rubber.

Figure 15C:
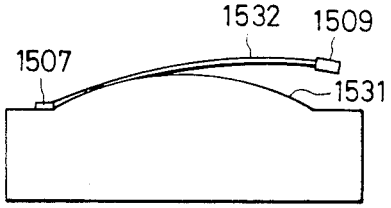

In the case of FIG. 15*b*, instead of a flexible stretchable retainer, a thin-plate-shaped retainer 1522 which is not stretchable, but preferably elastic and flexible is employed. It may have a soft elastic layer (such as a sponge layer) 1523. The original retainer 1522 may be made of a thin metal or plastic plate 0.1 to 1 mm in thickness. A suitable example of the soft elastic layer 1523 is a white plastic film formed on the surface of a resin foam layer.

Where the original placing stand is arcuate as shown in FIG. 15*c*, it is unnecessary for the original retainer 1532 to be stretchable and elastic; however, it is necessary that the original retainer 1532 be flexible. The original retainer 1532 may be made of a white film of polyester or polyethylene.

Figure 15D:
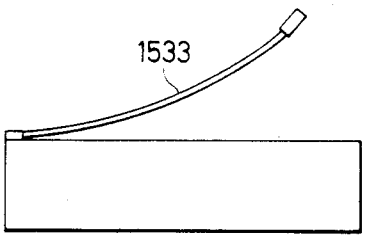

In the case where the original placing stand is flat and no soft elastic member 1523 (FIG. 15*b*) is available, a thin plate 1533 which is elastic and flexible and which is bent backwards as shown in FIG. 15*d* may be employed instead of the retainer 1522 in FIG. 15*b*. With the bent thin plate, the original can be uniformly depressed. The member 1533 may be made similarly to the member 1522. The original retainer in FIG. 15*c* may have a soft elastic member 1523 as shown in FIG. 15*b*.

Another aspect of the invention for preventing the original support from being charged will now be described.

The original support made of plastic film is supported and wound of the pair of rolls, as described before. Accordingly, the original support is electrically charged by friction between the original support and the rolls, or between the original support and the original. In addition, the original support may be charged by photosensitive material which has been charged. When the original support is charged, the electrostatic charge attracts the original. Accordingly, when the original support is moved with the original maintained at rest, it cannot slide smoothly and discharge may occur between the original support and the electrostatic latent image. This discharge damages the latent image, thus lowering image quality. In order to prevent the charging phenomenon, it is desirable to coat that surface of the original support which confronts the original with a material having a small coefficient of friction, such as ethylene tetrafluoride resin or silicone oil.

Figure 16A:
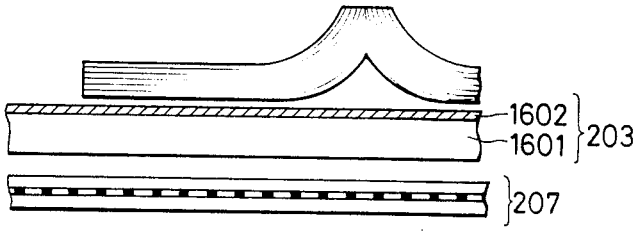
FIGS. 16*a* and 16*b* are sectional views showing examples of the transparent conductive layer of an original support of the invention.
Figure 16B:
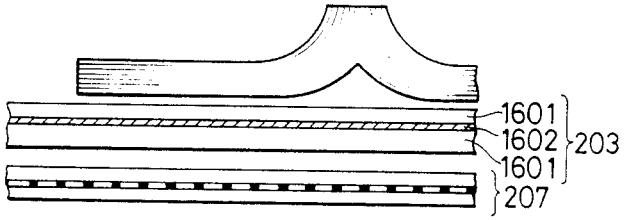

In the case of FIG. 16*a*, in order to eliminate the above-described drawback due to charging, a conductive layer is formed on the original support. In FIG. 16*a*, reference numeral 1601 designates a transparent plastic member made of a polyethylene terephthalate film or polycarbonate film 15 to 200 $\beta$m in thickness, preferably 25 to 100 $\beta$m; and at 1602 is a transparent conductive layer which is formed by vacuum-evaporating conductive material such as tin oxide, indium oxide or copper iodide on the plastic member 1601 or by coating the plastic member 1601 with a solution prepared by dispersing particles of the above-described conductive material in a polymer solution.

Grounding of the transparent conductive layer can prevent the original support surface from being charged.

The transparent conductive layer 1602 may be provided buried in the original support. However, the example in FIG. 16*a* is more effective in preventing charging.

The above-described transparent conductive layer is for preventing unwanted charging. It may be formed not only on the original support, but also on the rear side of the film-shaped electrophotographic photosensitive material or on the outer and/or inner surface of the planar light source. The transparent conductive layer may be formed on the rear side of the film-shaped electrophotographic photosensitive material by the same method as described with reference to the planar light source or the original support.

Figure 17A:
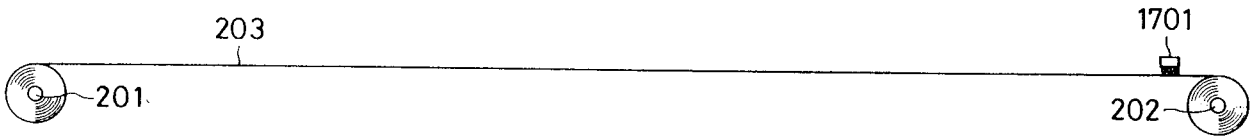
FIGS. 17*a* through 17*c* are explanatory diagrams showing examples of discharging means employed in the invention.

FIG. 17*a* shows a method of preventing charging using a discharging brush. Charges imparted to the original support 203 leak through the grounded discharging brush 1701, as the original support 203 passes by the brush 1701. The discharging brush 1701 may be positioned other than as shown in FIG. 17*a*. That is, it may be positioned at any location where unwanted charging is caused, such as at the rear side of the original support. A plurality of discharging brushes may be positioned as the case may be. The discharging brush 1701 is made of a conductive material such as conductive polymer, carbon fiber or metal fiber in the form of a brush.

Figure 17B:
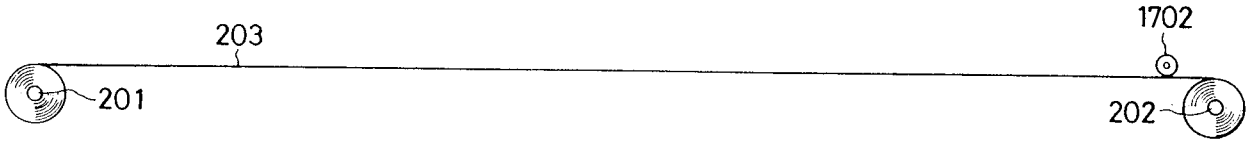

In the case of FIG. 17*b*, a conductive soft rubber or sponge roller 1702 is brought into contact with the original support 203.

In the above-described case, the discharging means is provided for the original support 203; however, it goes without saying that it may be provided for a part which may be unnecessarily charged, such as the original retainer, the rear side of the electrophotographic photosensitive material, or the surface of the planar light source as the case may be.

Figure 17C:
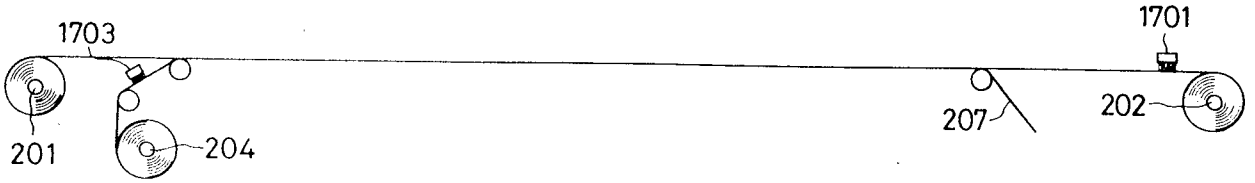

In the case of FIG. 17*c*, a charging/discharging brush 1703 is provided for the electrophotographic photosensitive material 207. It is preferable that the copying machine be designed so that a potential can be applied to the brush 1703. In charging the image forming region of the photosensitive material 207, potential is applied to the brush 1703 so that the brush serves as a charging unit. When the photosensitive material 270 is rewound, the potential is set to zero so that the brush 1703 serves as a discharging unit. That is, the brush can operate as both a charging and discharging unit.

The discharging effect can be improved by applying an AC voltage to the discharging brush.

Each of the copying machine described with reference to FIGS. 2 through 15 is laid horizontally; however, where the copying machine is to be used in a small space, it may be set vertically.

If the essential components of the electrophotographic copying machine, such as the developing unit, the charging unit, the cleaning unit and the photosensitive materials are each provided in the form of a cassette, then they can be readily replaced after use over a predetermined period of time or after a predetermined number of times, which facilitates maintenance. This can be said of all the above-described examples or modifications of the copying machine according to the invention.

The copying machine can be readily carried if it is provided with a handle or grip. If the copying machine is designed so that whenever a predetermined number of copies have been made the photosensitive material and/or the original support is advanced by as much as the width of one frame or predetermined length to provide a new (unused) surface for the copying operation, the copying machine will be more effective in practical use.

Another embodiment of the invention will now be described. Each of the above-described examples of the small electrophotographic copying machine according to the invention is placed somewhere such as on a desk when used, although they are portable. In practical operation, an original is placed on the original placing stage or is supplied into the copying machine together with a copying sheet. Accordingly, it is always necessary to bring originals to the copying machine, and it is absolutely impossible to copy immovable or nonportable documents.

In view of the foregoing, in the electrophotographic copying machine described below, an original placed at a optional position can be scanned, and the image of the original transferred onto the transfer medium. The copying machine is still portable.

Figure 18:
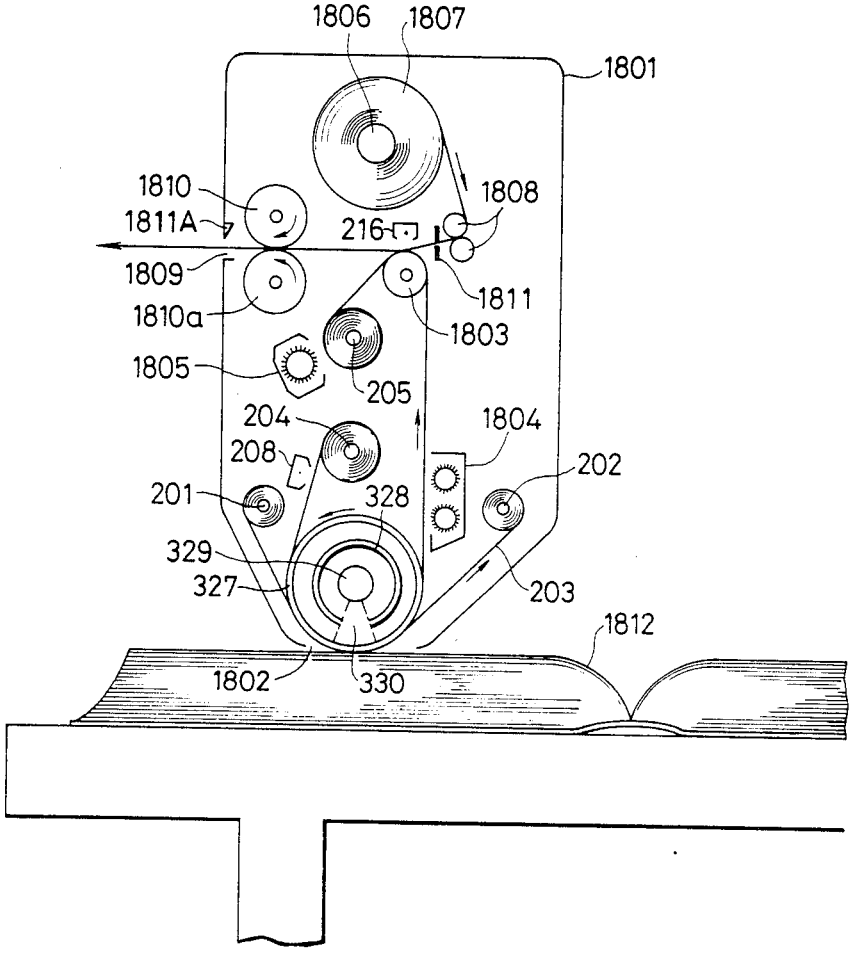
FIG. 18 an explanatory diagram showing the arrangement of a portable electrophotographic copying machine according to another aspect of the invention.

The electrophotographic copying machine shown in FIG. 18 is one modification of the copying machine shown in FIG. 3. More specifically, the copying machine is modified such that the mechanism is set up-side down and its size is reduced to the extent that the copying machine can be held by one's hand. Therefore, in the copying operation, the original is scanned with the copying machine held by a single hand.

In FIG. 18, reference numeral 1801 designates a casing which has an opening 1802 at the bottom. The drum 327 is supported on the bottom in a manner such that it appears in the opening 1802. A drive source (not shown) is coupled to the drum 327 to rotate it at a predetermined speed. One end portion of the electrophotographic photosensitive material 207 is wound on a roll 204, and the other end portion is wound on a roll 205. The photosensitive material 207 thus wound is laid over the drum 327. A drive source such as a motor (not shown) is coupled to the rolls 204 and 205, so that the photosensitive material 207 is wound on the roll 205 or 204. A charging unit 208 is provided between the roll 204 and the drum 327, in order to charge the photosensitive material 207. The charging unit 208 may be a conventional one such as a corona charging unit, an electrode contact type charging unit or a friction type charging unit. A portion of the photosensitive material 207, which appears in the opening 802, is covered with an insulating film 203. Both end portions of the insulating film 203 are wound on rolls 201 and 202 provided on both sides of the drum 327. A drive source such as an electric motor is coupled to the rolls 201 and 202, so that the insulating film 203 is wound on the rolls 201 and 202.

A light source 329 such as a fluorescent lamp for subjecting the photosensitive material 207 on the drum to exposure is provided inside the drum 327 in such manner that it extends parallel to the axis of the drum 327. The light source 329 is surrounded by a shielding tube 328 which has a slit 330 parallel to the axis of the drum so that only a part of the photosensitive material 207 (a substantially middle portion of the part of the photosensitive material which appears in the opening 1802) is irradiated by the light source 329.

A developing means, namely, a toner developing unit 1804 is arranged between the drum 327 and the roll 1803. The toner developing unit may be one operated according to a conventional developing method such as a magentic brush type developing method. In order to clean the surface of the photosensitive material 207, a cleaning unit 1805 is provided beside the roll 205 on which the photosensitive material 207 is wound.

On the other hand, a belt-shaped transfer sheet 1807 wound on a roll 1806 is incorporated in the upper part of the casing 1801. The transfer sheet 1807 passes through a pair of nip rolls 1808, contacts the photosensitive material 207 at the roll 1803 and exits the copying machine through an outlet 1809 cut in one side of the casing 1801. A transferring means, namely, a transfer unit 216 confronts the roll 1803. The transfer unit 216 operates to charge the transfer sheet 1807 in the opposite polarity to that of toner, to transfer the toner on the photosensitive material onto the transfer sheet 1807. A fixing means, namely, a pair of rolls 1810 and 1810*a* are provided between the transfer unit 216 and the outlet 1809, so that the transfer sheet 1807 is run through the rolls 1810 and 1810*a*. The heat roll 1810 is connected to a drive source (not shown) so that the toner transferred onto the transfer sheet 1807 isled out of the copying machine.

In FIG. 18, reference numeral 1811 designates a cutter provided between the roll 1803 and the nip roll 1808.

Instead of a transfer sheet in the form of a roll, a transfer sheet in the form of a flat sheet may be manually loaded in the copying machine. In this case, it is unnecessary to drive the sheet roll and to use the cutter, which contributes to a simplification of the structure. Instead of the cutter 1811, a saw tooth blade 1811A can be mounted on the outlet 1809, and the sheet can be cut by hand. This also simplifies the structure and reduces the weight and size of the machine.

The operation of the copying machine thus constructed will now be described.

First, a copy switch (not shown) is turned on. As a result, the drum 327 is rotated at a predetermined speed, and the photosensitive material 207 and the insulating film 203 are run in the same direction in synchronization with the peripheral speed of the drum. On the other hand, the charging unit 208, the toner developing unit 1804 and the cleaning unit 1805 are activated, and the light source 329 is turned on.

When the part of the photosensitive material 207 which has been charged by the charging unit 208 arrives at the position irradiated by the light source 329, the copying machine is ready for copying an original. This timing is preferably indicated to the operator, for instance, by flickering a lamp.

In this condition, the copying machine is set by holding the casing with the hand so that that part of the photosensitive material 207 which appears in the opening 1802 and is covered with the insulating film 203 is in close contact with the original 1812. At the same time, or a short time later, the heat roll 1810 is activated, the transfer sheet 1807 is run, and the transfer unit is operated.

In the condition that the photosensitive material 207 is in contact with the original 1812 through the insulating film 203, the original 1812 is scanned by the copying machine at a constant speed in synchronization with the running speed of the photosensitive material 207. As the photosensitive material 207 is subjected to close contact relation exposure by the light source 329, the electrostatic latent image of the original is formed on that part of the photosensitive material 207 which is in contact with the original 1812. As the photosensitive material 207 passes through the toner developing unit 1804, the electrostatic latent image on the photosensitive material 207 is developed into a toner image. As the photosensitive material 207 passes through the transfer unit 216, the electric field generated to attract the toner causes the toner image on the photosensitive material 207 to be transferred onto the sheet 1807 which is run in synchronization with the photosensitive material 207. When, thereafter, the sheet 1807 passes through the heat roll 1810, the toner image on the sheet 1807 is thermally fixed, i.e., the image of the original is copied. Then, the sheet 1807 is led out of the copying machine through the outlet 1809. The transfer sheet 1807 is then cut by the cutter 1811.

According to the above-described embodiment, the original is copied by scanning the portable electrophotographic copying machine over the original. Therefore, an original which cannot be readily moved can be copied with the copying machine according to the invention. Since the copying machine is portable, an original can be copied at any position.

What is claimed is:

1. A small electrophotographic copying machine, comprising;

an original support comprising a transparent plastic film in the form of a belt wound on roll means;

a film-shaped electrophotographic photosensitive material, an electrostatic latent image being formed on a surface of said photosensitive material when light is applied thereto from behind under the condition that said original support is interposed between the surface of said photosensitive material and an original surface, and where the surface of said photosensitive material, said original support and said original surface are in contact with one another, means for charging the surface of said photosensitive material, exposure means wherein the surface of said charged photosensitive material is brought into close contact with the rear surface of said original support at least at an exposure region, and the surface of said original which is in contact with the surface of said original support is irradiated by light from behind said photosensitive material, to form the image of said original as an electrostatic latent image on the surface of said photosensitive material, and means for synchronously moving said original support and said photosensitive material at least in said exposure region.

2. A machine as claimed in claim 1, wherein said light source is stationary.

3. A machine as claimed in claim 1, wherein a light intercepting member for intercepting external light is provided below said original support and above said photosensitive material except for at least said exposure region.

4. A machine as claimed in claim 1, wherein said machine further comprises an original retainer movable in synchronization with said original support in a manner such that an original is held between said original retainer and said original support.

5. A machine as claimed in claim 4, wherein said original retainer includes hinge means whereby it can be swung upwardly with one edge thereof as a fulcrum.

6. A machine as claimed in claim 1, said machine further comprising developing means for subjecting an electrostatic latent image formed on said photosensitive material surface to toner development; and a toner image transfer means for transferring a toner image formed by toner development onto a transfer medium.

7. A machine as claimed in claim 1, said machine further comprising latent image transfer means for transferring an electrostatic latent image formed on said photosensitive material surface onto a transfer medium; and developing means for subjecting said latent image on said transfer medium to toner development.

8. A machine as claimed in claim 7, said machine further comprising fixing means for fixing a toner image formed on said transfer medium.

9. A machine as claimed in claim 8, wherein said fixing unit comprises a fixing drum comprising a cylinder made of a transparent material which passes infrared rays and/or visible rays, said cylinder incorporating an infrared ray and/or visible ray emitting element and being covered with a member which absorbs at least 70% of said infrared rays and/or visible rays.

10. A machine as claimed in claim 8, wherein the surface of an arbitrarily positioned original is scanned to transfer the image of said original onto a transfer medium, said machine being of a size such as to be hand held during said scanning.

11. A machine as claimed in claim 8, wherein a bottom of a transfer medium containing section comprises a part of the housing of said copying machine.

12. A machine as claimed in claim 11, wherein said housing has an opening through which transfer media are loaded in said transfer medium containing section.

13. A machine as claimed in claim 11, including means enabling said copying machine to be swung vertically with said transfer medium containing section as a fulcrum, to load transfer media therein.

14. A machine as claimed in claim 11, wherein said transfer medium container section includes a bottom plate operable to load transfer media therein.

15. A machine as claimed in claim 1, wherein said copying machine further comprises an original retainer made of a thin material, said original retainer being supported via a supporting member on said copying machine body at one end and having fixing means at the other end engageable with holding means on said copying machine body, said thin material being stretchable such that said original retainer is depressed against said original support.

16. A machine as claimed in claim 1, wherein said copying machine further comprises an original retainer supported via a supporting member on said copying machine body at one end and being made of a plate-shaped member.

17. A machine as claimed in claim 1, wherein said copying machine further comprises an original retainer comprising an elastic, flexible and thin-plate-shaped member supported via a supporting member on said copying machine body at one end, said original retainer being curved against the surface of said original.

18. A machine as claimed in claim 17, wherein said original retainer includes a soft, elastic member on the original surface side thereof.

19. A machine as claimed in claim 1, wherein the surface of said original support which is brought into contact with said original surface comprises a member having a low coefficient of friction.

20. A machine as claimed in claim 1, wherein a transparent conductive layer is provided at at least one of the surface and interior of said transparent original support.

21. A machine as claimed in claim 1, wherein said film-shaped electrophotographic photosensitive material comprises a belt wound on roll means.

22. A machine as claimed in claim 1, wherein said photosensitive material includes a rear surface comprising a member having a small coefficient of friction.

23. A machine as claimed in claim 1, wherein said photosensitive material includes a rear surface comprising a transparent conductive layer.

24. A machine as claimed in claim 1, said copying machine comprising discharge means for removing electrostatic charges from a part of said photosensitive material other than that part of said photosensitive material where an electrostatic latent image is formed.

25. A machine as claimed in claim 24, wherein said discharge means comprises a soft, conductive material.

26. A machine as claimed in claim 1, wherein said charging unit for charging the surface of said photosensitive material further comprises a discharging means.

27. A machine as claimed in claim 6, said machine further comprising fixing means for fixing a toner image formed on said transfer medium.

28. A machine as claimed in claim 1, wherein said film shaped electrophotographic photosensitive material is in the form of an endless belt.

29. A small electrophotographic copying machine, comprising; an original support comprising a transparent plastic film;

a film-shaped electrophotographic photosensitive material, an electrostatic latent image being formed on a surface of said photosensitive material when light is applied thereto from behind under the condition that said original support is interposed between the surface of said photosensitive material and an original surface, and where the surface of said photosensitive material, said original support and said original surface are in contact with one another, means for charging the surface of said photosensitive material, and exposure means wherein the surface of said charged photosensitive material is brought into close contact with the rear surface of said original support at least at an exposure region, and the surface of said original which is in contact with the surface of said original support is irradiated by light from behind said photosensitive material, to form the image of said original as an electrostatic latent image on the surface of said photosensitive material, wherein, when said original support and said photosensitive material are in close contact with each other and held at rest, exposure is carried out by applying light thereto from behind said photosensitive material.

30. A machine as claimed in claim 29, including means for scanning an exposure light source along the rear surface of said photosensitive material.

31. A machine as claimed in claim 3, wherein said exposure light source is a stationary planar light source.

32. A machine as claimed in claim 4, wherein the surface of said planar light source which is brought into contact with the rear surface of said photosensitive material is curved outwardly.

33. A machine as claimed in claim 4, wherein the surface of said planar light source comprises a material having a low coefficient of friction.

34. A machine as claimed in claim 4, including a transparent conductive layer formed at at least one of the surface of said planar light source and inside said planar light source.

35. A machine as claimed in claim 4, wherein said planar light source comprises an electroluminescent plate.

36. A machine as claimed in claim 29, wherein said machine further comprises an original retainer movable in synchronization with said original support in a manner such that an original is held between said original retainer and said original support.

* * * * *